United States Patent [19]

Dayan

[11] Patent Number: 4,756,162

[45] Date of Patent: Jul. 12, 1988

[54] METHOD OF UTILIZING THERMAL ENERGY

[76] Inventor: Abraham Dayan, 27 Schaffer Rd., P.O. Box 115, Alpine, N.J. 07620

[21] Appl. No.: 40,835

[22] Filed: Apr. 9, 1987

[51] Int. Cl.[4] ..... F01K 25/06

[52] U.S. Cl. ..... 60/673; 60/649

[58] Field of Search ..... 62/476; 60/649, 673

[56] References Cited

U.S. PATENT DOCUMENTS 4,183,218 1/1980 Eberly, Jr. ..... 60/673

4,573,321 3/1986 Knaebel ..... 60/673 X

*Primary Examiner*—Allen M. Ostrager

*Attorney, Agent, or Firm*—Browdy and Neimark

[57] ABSTRACT

A method is provided for utilizing sensible heat energy supplied by a high-temperature heating fluid, employing a multi-component working fluid thermodynamic cycle, wherein a solution rich in a lower boiling component is heated in a vapor generator in counter-current heat exchange with the heating fluid to produce a vapor-fluid mixture which is separated in a rectifier into a lean solution and a vapor mixture; the enthalpy of the vapor mixture is optionally increased in a superheater by counter-current heat exchange with said heating fluid at its highest temperature; the vapor mixture is then expanded thereby to perform the function of the cycle; and the spent vapor mixture is dissolved in said lean solution in an absorber so as to regenerate the rich solution; characterized in that the rich solution leaving the absorber is compressed and divided into a first and second parts; the first part is heated by counter-current heat exchange with said lean solution drawn from the rectifier, whereafter said first part of the rich solution is recycled to the vapor generator; whereas the second part of the rich solution extracts additional heat from the heating fluid leaving the vapor generator, by counter-current heat exchange, and is then fed into the rectifier for counter-current mass and heat exchange with the vapor-liquid mixture formed in the vapor generator.

8 Claims, 5 Drawing Sheets

Prior Art

METHOD OF UTILIZING THERMAL ENERGY

This invention concerns a method for utilizing heat energy supplied by high temperature sensible heat sources, such as the exhaust gases of a combustion turbine, for the purposes of power generation or refrigeration, by employing a thermodynamic cycle operating with a multi-component working fluid system.

Multi-component working fluid thermodynamic cycles are well known and have been proposed and employed both in the field of power generation and refrigeration, as well as in other related fields. Such cycles employ a multi-component (in most cases a binary) working fluid system comprising at least one comparatively volatile fluid component (hereinafter "the lower boiling component") and at least one "carrier fluid" component having a considerably higher boiling temperature than said volatile fluid component and a high degree of absorptivity for the volatile fluid, so as to form a solution. Many of the multi-component thermodynamic cycles hitherto proposed and employed, operate with a binary or so-called "dual" working fluid system consisting of ammonia as the volatile fluid and water as the carrier fluid. Thus, for example, in a heat engine falling within this category, i.e. operating with an ammonia/water binary working fluid, a "rich" solution of ammonia in water is heated in a vapor generator (or boiler) so as to produce a gaseous mixture rich in ammonia and a residual dilute or "lean" solution. The high pressure gaseous ammonia is expanded in a turbine to transform its energy into useable mechanical energy, whereafter the spent ammonia gas is passed to an absorber wherein it is reabsorbed, under cooling in the lean solution drawn from the vapor generator, so as to regenerate a rich solution for recycling to the vapor generator.

As contrasted to the constant temperatures prevailing in the boiler and condenser of a pure-fluid Rankine cycle, the separation of a multi-component working fluid mixture in the vapour generator (or distiller), as well as the regeneration of the mixture of the fluid components in the absorber of such a multi-component cycle, take place within finite temperature ranges, owing to the gradual changes in the composition of fluid mixtures which become gradually poorer or richer in the more volatile component, in the vapour generator and the absorber, respectively. This fact, inter alia, renders such multi-component working fluid thermodynamic cycles especially suitable for combination with a gas turbine in so-called compound power plants where the hot exhaust gases from a combustion process or a gas turbine serve as a sensible heat source of variable temperature, mainly for the vapor generator or boiler of the multi-componet working fluid cycle.

It is an object of the present invention to provide an improved multi-component working fluid thermodynamic cycle having an increased thermodynamic efficiency and capable of utilizing the sensible heat energy of a high-temperature external energy source more efficiently than hitherto known cycles of this type.

The above object is achieved in accordance wih the invention, which provides a method for utilizing sensible heat energy supplied by a high-temperature heating fluid, for power generation or for refrigeration, employing a multi-component working fluid thermodynamic cycle, wherein a solution having a higher concentration of lower boiling component or components (hereinafter "rich solution") is heated in a vapor generator in countercurrent heat exchange with the heating fluid to produce a vapor-liquid mixture which is introduced into a lower zone of a rectifier and separated therein into a solution having a lower concentration of said lower boiling component or components (hereinafter "lean solution") and a vapor mixture; if desired, the enthalpy of the vapor mixture is increased by passing it through a superheater in counter-current heat exchange with said heating fluid at its highest temperature; the vapor mixture is then expanded to a low pressure level thereby to perform the function of the cycle; and the spent vapor mixture is introduced into an absorber wherein it is dissolved in said lean solution, under heat rejection to an external coolant, so as to regenerate a rich solution;

said method being characterized in that:

(a) the pressure of the rich solution regenerated in the absorber is increased and the solution is divided into a first and second parts;

(b) said first part of the rich solution is heated in a regenerative preheater by counter-current heat exchange with said lean solution which is drawn from the lower zone of the rectifier, whereafter said first part of the rich solution is recycled to the vapor generator, whereas said lean solution is decompressed by means of an expansion device and fed to the absorber;

(c) said second part of said rich solution is passed through a preheater to extract, by counter-current heat exchange, additional heat from the heating fluid leaving the vapor generator, and is then fed into the vapor zone of the rectifier for counter-current mass and heat exchange with said vapor-liquid mixture, thereby to increase the concentration of the lower boiling component in said vapor mixture;

(d) the mass flow-rate of said first part of the rich solution is determined so as to render its apparent heat capacity mass flow rate substantially equal to that of said lean solution passing counter-current thereto through the regenerative heat exchanger;

(e) where said cycle is employed for power generation and includes a superheater, the composition of the vapor mixture leaving the rectifier is adjusted, by controlling the pressure of the rich solution leaving the absorber and the mass flow rate of the higher boiling component, or components, circulating between the absorber and the rectifier, within technological limits, so that, for a selected vapor mixture flow rate, the temperature of the vapor mixture leaving the superheater is maximized.

In accordance with a preferred embodiment of the invention, the absorber is of the heat recuperative type wherein the regenerated rich solution is recirculated through the absorber through continuous flow channels in an indirect heat exchange relationship with the fluid mixture in the absorber so as to extract a substantial proportion of the heat of absorption generated in the absorber. Most preferably, the absorber is a multiple-stage recuperative absorber as disclosed in Kogan et al., U.S. Pat. No. 4,534,175.

In accordance with another preferred embodiment of the invention, the rich solution in the vapor generator is heated not only by the heating fluid, but also by internal heat recovered from the cycle via one or more internal working fluid streams circulated in counter-current heat exchange relationship with a portion of the rich solution passing through the vapor generator.

The invention will now be described in more detail and its advantages explained, having reference to the accompanying non-limiting drawings, in which.

Figure 4:
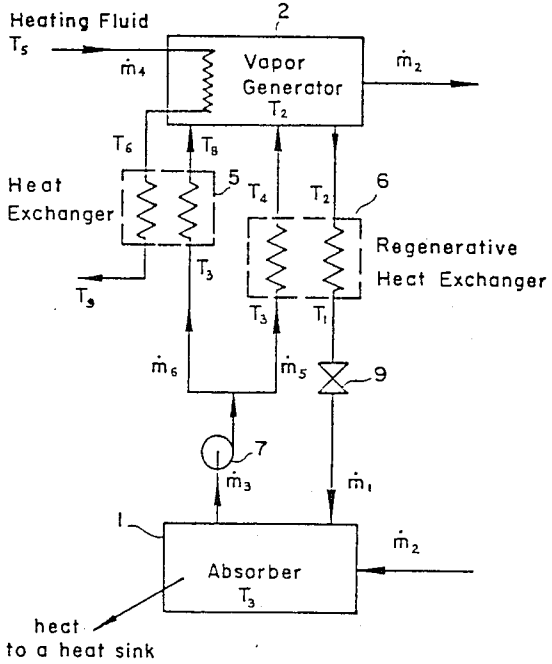
FIG. 4 is a diagrammatic representation of a multi-component thermodynamic cycle illustrating an improvement in accordance with one feature of the present invention.
Figure 5:
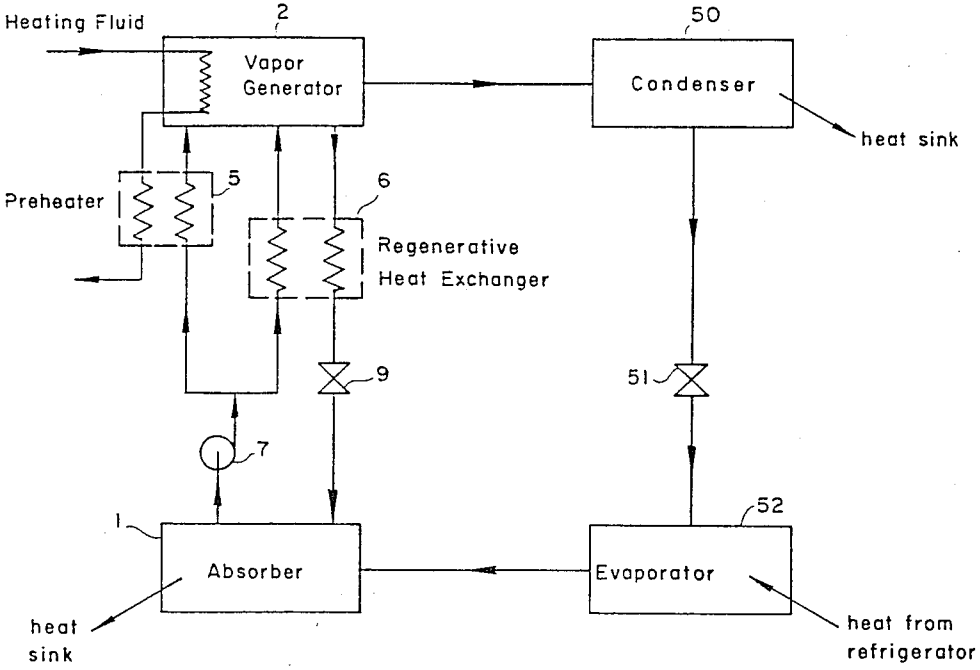
Figure 6:
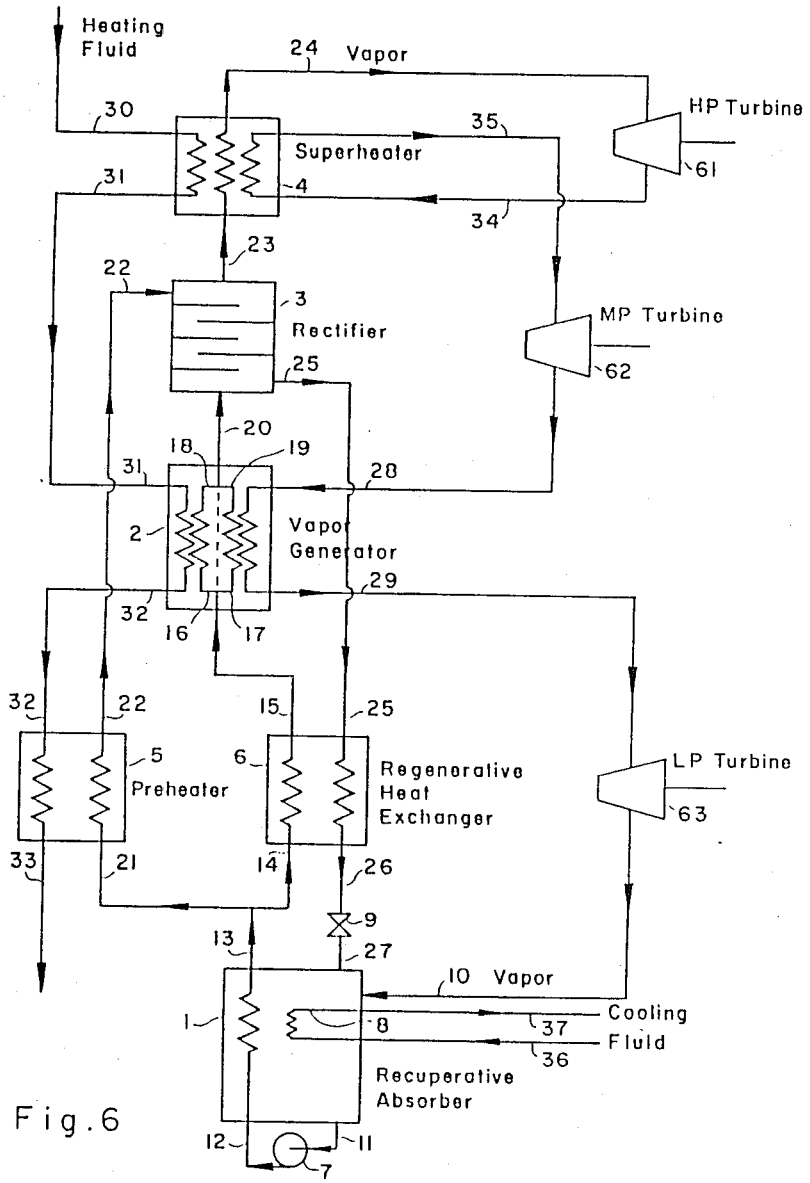

FIG. 5 is a diagrammatic representation of a multi-component absorption refrigeration cycle incorporating the improvement according to the invention which is illustrated in FIG. 4; and FIG. 6 is a schematic flow sheet representing a binary working fluid thermodynamic cycle in accordance with the present invention which is adapted for power generation and operates with an ammonia/water working fluid system.

As is well known in the art (cf, e.g., the aforementioned Kogan et al. U.S. Pat. No. 4,534,175), the compressed rich solution recirculated through the absorber, when this is of the recuperative type, may start to boil in the absorber or, particularly, during the passage of the first and second parts of this rich solution through the regenerative heat exchanger and the preheater, respectively. Since the boiling process of multi-component fluids also exhibits sensible heat characteristics (i.e. change of temperature with changes of energy content), one must consider the apparent heat capacities of each respective stream of working fluid in the cycle. Thus, the term "apparent heat capacity mass flow rate" used herein means, as should be clear to a man of the art, the mass flow rate of any specific stream multiplied by the apparent heat capacity of the fluid mixture of this stream (which may be a mixture of gas and liquid) averaged over the particular section of the path of this stream.

The principles of the novel thermodynamic cycle according to the present invention, incorporating the two preferred embodiments mentioned above, are schematically illustrated in FIG. 1 of the accompanying drawings. The part of the cycle depicted in FIG. 1 comprises a recuperative absorber 1, a vapor generator 2, a rectifier 3, a superheater 4, a preheater 5, a regenerative preheater 6, a pump 7 for compressing and recirculating the rich solution to the absorber 1, an external cooling fluid system 8 for cooling the fluid mixture in the absorber 1 and an expansion device 9.

In operation, a spent vapor mixture 10, which may contain some condensate liquid, at a comparatively low pressure, enters the absorber 1 wherein it is condensed by absorption in a weak solution 27. The absorber 1 is preferably a multi-stage heat recuperative absorber, in which case the weak solution 27 and the vapor 10 are introduced into the absorber 1 at opposite ends thereof in counter-current flow to each other. A desired portion of the heat of absorption generated in the absorber 1 is rejected to an external cooling fluid circulating through the cooling system 8. The rich solution 11 regenerated in the absorber 1 is compressed to a high pressure by the pump 7 and the compressed rich solution 12 is recirculated back into the absorber 1, preferably in a direction from the lowest to the highest temperature zones therein, so as to gain heat from the absorption process. The heated rich solution 13 leaving the absorber is divided into a first part 14 and a second part 21.

The first part of the rich solution in stream 14 is first heated in the regenerative preheater 6 by counter-current heat exchanger with the weak solution 25 drawn from the lower zone of the rectifier 3. In this process, the rich solution is heated to afford the stream 15 and is likely to develop some vapor, while the weak solution 25 is cooled to afford the stream 26 which is then decompressed by passage through the expansion device 9 to afford the weak solution stream 27 fed to the absorber 1. The thus heated rich solution stream 15 is fed to the vapor generator 2 wherein it is divided into two streams 16 and 17. The vapor generator 2 is constructed as a counter-current heat exchanger consisting of two parts. The rich solution stream 16 is introduced into one part of this heat exchanger wherein it is heated to partial or full vaporization by counter-current heat transfer from the heating fluid, i.e. the gaseous high temperature heat source which enters the vapor generator 2 at 31, leaving it at 32. The other rich solution stream 17 is passed through the other part of the counter-current preheater of the vapor generator wherein it is heated to partial or full evaporation by heat exchange with an internal working fluid stream which enters the vapor generator 2 at 28 and leaves at 29. The two heated streams 18 and 19 leaving the two parts of the preheater of the vapor generator are combined into one stream 20 which feeds a mixture of vapor or a mixture of liquid and vapor into the lower zone of the rectifier 3.

The second part of the rich solution 13 leaving the absorber 1 in stream 21, is passed through the preheater 5 in counter-current heat exchanger relationship with the stream 32 of the heatinng fluid emerging from the vapor generator 2. In this process, residual sensible heat of the heating fluid in stream 32 is transferred to the rich solution in stream 21 which is thereby heated, preferably to or just below the saturation temperature, and leaves the heat exchanger 5 as stream 22, without vapor but ready for vaporization upon further heating, whereas the exhausted heating fluid leaves the preheater 5 as stream 33.

The preferably saturated stream 22 of the rich solution leaving the preheater 5 is introduced into the upper zone of the rectifier 3 for heat and mass transfer in counter-current flow with the vapor/liquid mixture that is introduced in stream 20 into the lower zone of the rectifier 3. In this heat and mass transfer process there are formed a lean liquid solution which is collected at the bottom zone of the rectifier 3 and flows therefrom as stream 25 to the regenerative preheater 6, and a desired vapor mixture which emerges from the upper zone of rectifier 3 as stream 23.

The vapor mixture stream 23 is passed through superheater 4 wherein it is further heated by counter-current heat exchange with the heating fluid at its highest temperature, which enters superheater 4 as stream 30 and leaves it as stream 31 to be fed into the vapor generator 2. The heated vapor mixture leaves superheater 4 as stream 24 to operate the thermodynamic cycle section which is not shown in FIG. 1, and after expansion in this section of the cycle to a low pressure level, the vapor mixture returns in stream 10 to the absorber 1.

As stated above, the mass flow rate of the rich solution stream 14, in proportion to stream 21, is determined so as to render the apparent heat capacity mass flow rate of stream 14 substantially equal to the apparent heat capacity mass flow rate of the stream 25 of the lean solution introduced into the regenerative heat exchanger 6. As further explained hereinbelow, this results in extraction of substantially all the recoverable sensible heat of the lean solution stream 25 by transfer to the rich solution stream 14 which leaves the regenerative preheater 6 at a maximum temperature, almost equal to the temperature of the entering heating stream 25.

The pressure and composition of the vapor mixture 23 leaving the rectifier 3 determine both the thermodynamic performance of the cycle and the efficiency of utilization of the heat source energy, and must be chosen so as to maximize them. These parameters, respectively, can be controlled within acceptable technological limits, by adjusting the setting of the pump 7 (i.e. the pressure of the rich solution stream 13 leaving the absorber 1) and the mass flow rate of the higher boiling component or components circulating between the absorber 1 and the rectifier 3 (via streams 11 to 22 and 25 to 27 in FIG. 1). As stated above, the aforesaid parameters are adjusted so that, for a selected flow rate of the vapor mixture stream 23, the vapor mixture leaves the superheater 4 as stream 24 at a maximum temperature.

The novel design of the multi-component working fluid thermodynamic cycle employed in the method of the present invention incorporates a number of improvements, all of which contribute to the resultant advantages of this cycle, namely increased thermodynamic efficiency of the cycle and better utilization of the sensible heat energy of the heat source (i.e. extracting more heat from the heating fluid or gas). One general principle underlying the design of the thermodynamic cycle was to approach thermodynamic reversibility, as much as possible, in the various sections of the cycle.

Thus, all preheaters in the cycle are of the counter-current flow type in order to achieve higher temperatures in the heating process. A counter-current preheater becomes more reversible when the two counter-current streams carry equal heat capacity mass flow rates, because this provides for heat transfer under minimum approach temperature differences between the two streams, along the entire heat exchanger. Therefore, the temperature of the heated stream leaving the preheater can approach the initial temperature of the heating stream which in the heat exchange process gives up the maximum of its transferable sensible heat. This applies in particular to the regenerative preheater (6 in FIG. 1) as will be explained in more detail hereinbelow. The counter-current heating process in the vapor generator (2 in FIG. 1) also results in the following advantages, as compared to the so-called "pool heating" such as in the bottom of a distiller or boiler:

i. higher temperatures of the boiling solution are reached, for a given heat source temperature, thereby increasing the quantity of vapor produced per unit mass of rich solution entering the vapor generator;

ii. more heat is extracted from the heating fluid which leaves the vapor generator at a considerably lower temperature than that of the boiling solution formed therein. (In "pool boiling" the heating fluid leaves the boiler at practilly the same temperature as that of the heated fluid.)

iii. a vapor generator structure as described above and illustrated in FIG. 1 enables the simultaneous use of different heat sources having different temperature ranges for the boiling process, thereby recovering heat energy from one or more internal streams of the cycle.

A more reversible heat and mass transfer is also achieved, in accordance with the invention, in the rectifier (3 in FIG. 1), the function of which is to supplement the vapor generator and to create a vapor mixture which is richer in the more volatile component of the working fluid. The heat and mass transfer process in the rectifier is performed in counter-current with little temperature differences between the descending saturated rich solution (stream 22 in FIG. 1) and the rising vapor mixture in the rectifier, resulting in a desired vapor composition with a high exit temperature (close to the temperature of the saturated solution entering the rectifier in stream 22), from which the volatile component is extracted and transferred to the vapor mixture.

Where the cycle according to the invention includes a superheater (4 in FIG. 1), the composition of the vapor mixture formed in the rectifier and fed to the superheater is controlled by means of adjusting the operation parameters of the rectifier, so as to maximize the temperature of the vapor mixture leaving the superheater (stream 24 in FIG. 10, for a desired vapor flow rate.

One of the important novel features of the multi-component thermodynamic cycle according to the present invention is the division of the stream of rich solution formed in the absorber into the two partial streams (14 and 21 in FIG. 10 which are passed through the regenerative preheater (6 in FIG. 1) and the heat exchanger (5 in FIG. 1), respectively, and the proportion of the mass flow rates in these two streams. Regenerative heat exchangers are common to many thermodynamic cycles that operate with a multi-component working fluid, and are installed in sections where a fluid is circulated back and forth between hot and cold sub-systems, e.g. between a vapor generator and an absorber. The main purpose of these known regenerative heat exchangers is to reduce the undesired thermal convection between, e.g., the vapor generators and the absorbers of these cycles. This is achieved by extracting the recoverable sensible heat from the hot flow of lean solution leaving the vapor generators to heat up the returning flow of rich solution from the relatively cold absorbers. In this manner, the entrance of a cold fluid to the relatively hot vapor generators is avoided, as well as the introduction of a relatively hot fluid into the absorbers. Clearly, such a regenerative heat transfer process saves both the heating requirements of the vapor generators and the cooling requirements of the absorbers. Despite the fact that most of these known regenerative heat exchanges operate in a counter-current flow, the heat transfer process therein is far from efficient, because of the differences in the mass flow rates of the two streams (and consequently their temperature differential). This deficiency of the hitherto current designs of regenerative preheaters are overcome by dividing the stream of the working fluid that must be heated, as mentioned above. The advantages of this arrangement according to the invention will be explained by referring first to known designs of regenerative heat exchange systems of this type.

Figure 1:
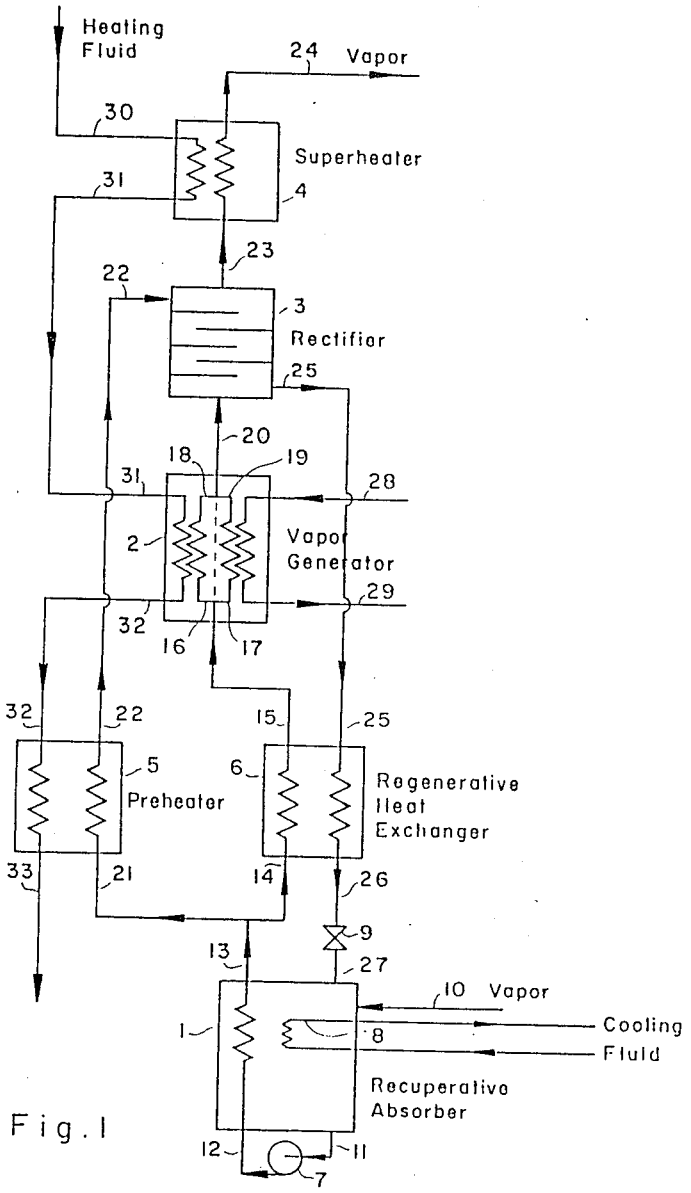
FIG. 1 is a schematic flow sheet representing a part of a multi-component working fluid thermodynamic cycle in accordance with the invention.
Figure 2:
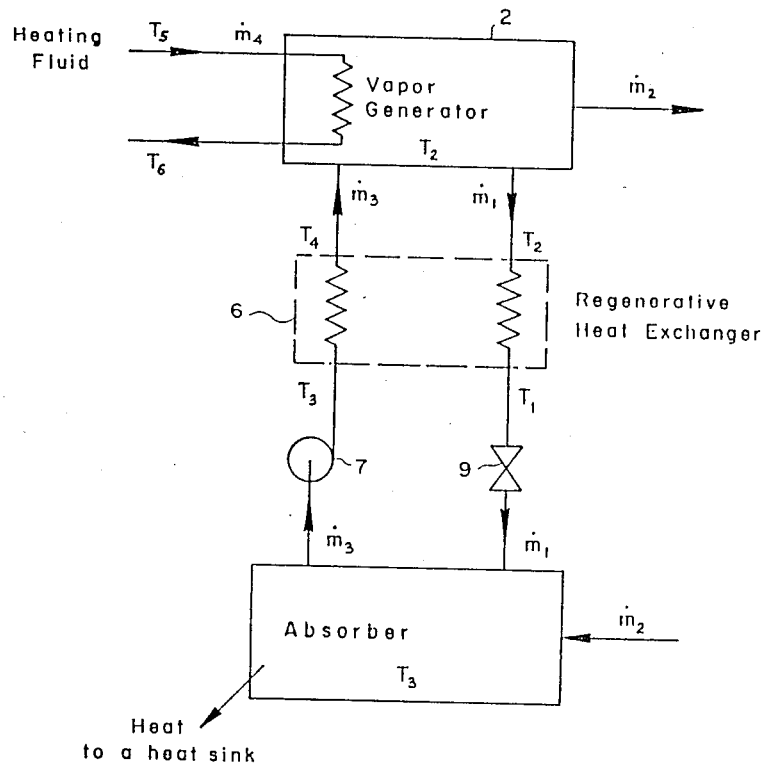
FIG. 2 is a diagrammatic representation of a part of conventional multi-component thermodynamic cycle.

A section of a typical multi-component thermodynamic cycle is schematically represented in FIG. 2. This section of the cycle is connected to the rest of the thermodynamic cycle by the working fluid leaving the vapor generator 2 at a mass flow rate $m_2$ and returning to the absorber 1 (in a different thermodynamic state, of course). The hot stream of a lean solution leaves the vapor generator 2 towards the absorber 1 at a mass flow $m_1$ and exchanges heat in a counter-current regenerative preheater 6 with the rich solution coming from the absorber 1 at a mass flow rate $\dot{m}_3$. The flows of both these circulating fluids ($\dot{m}_1$ and $\dot{m}_3$) as well as the pressure differential (which usually exists) between the vapor generator 2 and absorber 1 are driven and maintained by pump 7 and expansion device 9, as shown in FIG. 2. The temperatures at the four connections of the regenerative heat exchanger 6 are marked $T_1$, $T_2$, $T_3$ and $T_4$. Though vapor generators and absorbers are not necessarily isothermal systems, one may regard the temperature $T_2$ and $T_3$ as the characteristic temperatures of the vapor generator 2 and the absorber 1, respectively. As shown in FIG. 1, the vapor generator 2 is heated by a heating fluid, with a mass flow rate $\dot{m}_4$, and inlet and outlet temperatures $T_5$ and $T_6$, respectively. To maintain a relatively low temperature in the absorber, heat must usually be rejected therefrom to a heat sink (e.g. by means of an external cooling fluid).

As previously mentioned, the thermodynamic inefficiency of this regenerative heat-exchanger design is due to the difference in the mass flow rates $\dot{m}_1$ and $\dot{m}_3$ (notice that $\dot{m}_3=\dot{m}_1+\dot{m}_2$). The heat capacity associated with the mass flow rate $\dot{m}_3$ is consequently larger than that of $\dot{m}_1$. Thus, even if the temperatures $T_1$ and $T_3$ are practically identical, (i.e. all the recoverable sensible heat of stream $\dot{m}_1$ is transferred to stream $\dot{m}_3$), the temperature $T_4$ is still considerably lower than $T_2$, which means that the temperature differential between the two streams is increasing as one proceeds through the regenerative heat exchanger 6 towards the vapor generator 2. It follows that the stream $\dot{m}_1$ is incapable of heating the stream $\dot{m}_3$ to the temperature $T_2$ of the vapor generator 2.

Figure 3:
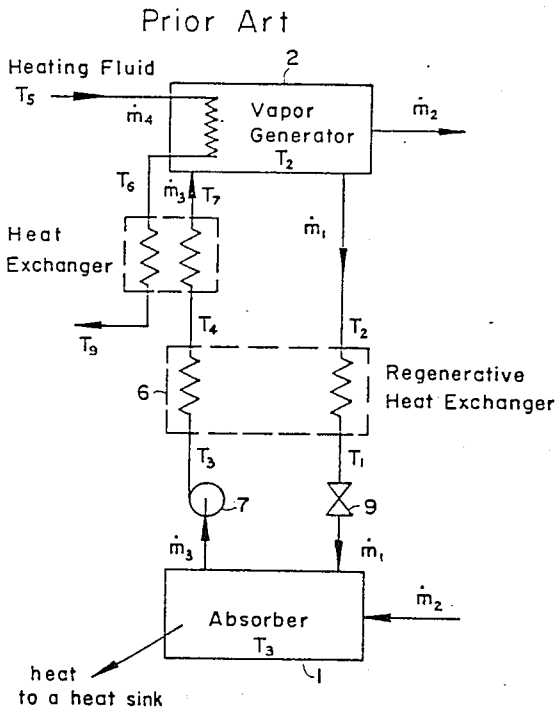
FIG. 3 is a diagrammatic representation of an improvement of the conventional cycle shown in FIG. 2.

The introduction of a relatively colder fluid into the vapor generator 2 and its mixing therein with a hotter fluid is thermodynamically inefficient (it increases the irreversibility of the cycle) because such mixing will lower the maximum attainable vapor generator temperature for a given heat source at a temperature $T_5$. This situation can be partially improved by preheating the stream $\dot{m}_3$ before its entry into the vapor generator 2, with the residual sensible heat left in the heating fluid leaving the vapor generator at a temperature $T_6$. Such an arrangement is schematically represented in FIG. 3. Such an improvement is, again, of limited value due to the large heat capacity of the stream $\dot{m}_3$. The heat capacity mass flow rate of the heating fluid is usually selected to be compatible with handling a mass flow rate of the order of $\dot{m}_2$ but not of $m_3$. Therefore, if the heating fluid leaving the vapor generator 2 exchanges heat in a counter-current flow with $\dot{m}_3$ (in between the regenerative preheater 6 and the vapor generator 2), the temperature of $\dot{m}_3$ will not reach $T_6$, which is practically the same as $T_2$ (on the above assumption that the vapor generator is an isothermal system), but rather be raised to an intermediate value $T_7$ between $T_4$ and $T_6$. However, the temperature $T_6$ of the heating fluid leaving the vapor generator 2 (which is usually slightly above $T_2$) will drop to $T_9$ which is essentially equal to $T_4$. This means that more heat would be extracted from the heating fluid, or in other words, there will be a better utilization of the heat source. Nevertheless, since such a design does not raise the temperature of $m_3$ high enough, it provides only a partial improvement.

The present invention provides a principle of design which overcomes the above deficiencies and improves still further the utilization of the energy source. The principle of the invention is illustrated in FIG. 4. As seen in FIG. 4, the flow leaving the absorber 1 towards the vapor generator 2 is divided into two parallel streams $\dot{m}_5$ and $\dot{m}_6$. The mass flow rate $\dot{m}_5$ can be determined so as to maximize the thermodynamic effectiveness of the regenerative heat exchange in 6 (in terms of reversibility). This can be achieved by selection of an $\dot{m}_5$ which, on the average, will have the same apparent heat capacity mass flow rate as that of the $\dot{m}_1$ stream. In this case the streams $\dot{m}_5$ and $\dot{m}_1$ would be thermodynamically compatible, the entire recoverable sensible heat of the $\dot{m}_1$ stream would be extracted to warm up the $\dot{m}_5$ stream to a temperature $T_4$ close to $T_2$ and the exit temperature $T_1$ of the stream $\dot{m}_1$ will be close to $T_3$. In such a case the mass flow rate $\dot{m}_5$ would be of the same order as $\dot{m}_1$ and it follows that the mass flow rate of $\dot{m}_6$ will be on the same order similar as the $\dot{m}_2$ mass flow rate and, therefore, would fall in the range of the heating capacity of the heating fluid. Using the residual sensible heat left in the heating fluid stream at $T_6$, the temperature $T_3$ of the stream $m_6$ can be raised to a value $T_8$ close to $T_6$. Furthermore, the heating fluid exit temperature $T_9$ in many cases may be of the same order as $T_3$. Thus, the method of the invention provides an improved heat source utilization since it allows for a larger heat transfer from the source to a more reversible system.

FIG. 5 is a schematic flow sheet illustrating the application of the above principle of the present invention to an absorption refrigeration cycle operating with a multiple-component working fluid. The absorption refrigeration cycle of FIG. 3 includes, in addition to the components of the cycle section illustrated in FIG. 4 (which have the same reference numerals as the corresponding components in FIG. 10, a condenser 50, an expansion device 51 and an evaporator 52. The vapor mixture generated in the vapor generator 2 is condensed in condenser 50, with heat rejection to a suitable heat sink, e.g. an external coolant. The liquified volatile component, or components, of the multi-component working fluid, is allowed to expand by passage through the expansion device 51 and is passed to the evaporator 52 wherein it evaporates, the heat of evaporation being extracted from the medium to be refrigerated (e.g. return air in the case of an air conditioning installation). In accordance with the present invention, such a refrigeration cycle will also include a rectifier (not shown in FIG. 5 for the sake of simplification), the function of which being in this case merely to enrich the generated vapor mixture as much as possible with the higher boiling component or components of the working fluid (e.g., ammonia in the case of a binary ammonia/water working fluid system), without taking into consideration an increase of the vapor temperature.

A much more elaborate application of the method of the invention for electric power generating is illustrated in FIG. 6 for the case of a binary ammonia/water working fluid and a high temperature exhaust gas from a gas turbine as the sensible heat source. As seen in FIG. 6, the cycle comprises essentially the same section which is illustrated in FIG. 1 and the same reference numerals are employed in FIG. 6 for the corresponding components and streams of the various fluids in the cycle. The remaining part of the cycle comprises three power turbines, namely a high pressure turbine 61, a medium pressure turbine 62 and a low pressure turbine 63.

In operation of the thermodynamic cycle of FIG. 6, the high enthalpy vapor mixture leaving the superheater 4 as stream 24 is first expanded in the high pressure turbine 61 to convert a part of its energy to mechanical work. The partially spent vapor mixture leaves turbine 61 in stream 34 and is recirculated through the superheater 4 in counter-current heat exchange with the heating fluid stream 30 having the highest temperature, so as to increase its enthalpy. The vapor mixture leaves superheater 4 in stream 35 and is expanded again in the medium pressure turbine 62 to produce additional mechanical work. The spent vapor mixture from turbine 62 leaves it in stream 28, which is passed through the vapor generator 2 to transfer some of its thermal energy to the rich solution, as explained above in connection with FIG. 1. The vapor mixture leaves the vapor generator 2 as stream 29 and is expanded in the low pressure turbine 63 to generate more mechanical work. The fully spent vapor mixture leaving the low pressure turbine 63 is fed, as stream 10, to the absorber 1 as explained above in connection with FIG. 1.

The following Table I shows the physical parameters of the various fluid streams in FIG. 6 (i.e. the working fluid, the heating fluid and streams 36 and 37 of the external cooling fluid entering and leaving the absorber 1), as calculated per unit mass flow rate of vapor mixture flowing from the superheater (stream 24) to the absorber (stream 10) via the three turbines 61, 62, 63.

TABLE I

| Stream No. | State | Vapor* quality | % $NH_3$ (w/w)** | Pressure psia | Temp. °C. | mass flow rate lb/sec | specific enthalpy BTU/lb |
|---|---|---|---|---|---|---|---|
| 10 | vapor | 1 | 65 | 25 | 87 | 1 | 800 |
| 11 | liq. | 0 | 45 | 25 | 15.5 | 2.9 | −75 |
| 12 | liq. | 0 | 45 | 2400 | 15.5 | 2.9 | −67 |
| 13 | liq. | 0 | 45 | 2400 | 33.3 | 2.9 | −33.5 |
| 15 | mix. | 0.134 | 45 | 2400 | 258 | 1.9 | 541.5 |
| 20 | mix. | 0.53 | 45 | 2400 | 272 | 1.9 | 690 |
| 22 | liq. | 0 | 45 | 2400 | 252.3 | 1 | 494 |
| 23 | vapor | 1 | 65 | 2400 | 252.3 | 1 | 775 |
| 24 | vapor | 1 | 65 | 2400 | 510 | 1 | 1225 |
| 25 | liq. | 0 | 34.5 | 2400 | 272 | 1.9 | 535 |
| 27 | liq. | 0 | 34.5 | 25 | 33.3 | 1.9 | −40 |
| 28 | vapor | 1 | 65 | 157 | 315.5 | 1 | 1031 |
| 29 | vapor | 1 | 65 | 157 | 258 | 1 | 969 |
| 30 | gas | | | | 565.5 | 6.09 | 1682 |
| 31 | gas | | | | 334 | 6.09 | 1014 |
| 32 | gas | | | | 258 | 6.09 | 794.4 |
| 33 | gas | | | | 75 | 6.09 | 267.5 |
| 34 | vapor | 1 | 65 | 600 | 305 | 1 | 1000 |
| 35 | vapor | 1 | 65 | 600 | 489 | 1 | 1218 |
| 36 | liq. | | | | 15.5 | | |
| 37 | liq. | | | | 32 | | |

*mass vapor/mass (liquid + vapor)
**weight per weight

Based on the data in Table I, the theoretical thermodynamic efficiency of the cycle illustrated by FIG. 6 was calculated to be 41% and the boiler efficiency to be 76.8%.

What is claimed:

1. A method for utilizing sensible heat energy supplied by a high-temperature heating fluid for power generation, employing a multi-component working fluid thermodynamic cycle, wherein a solution having a higher concentration of lower boiling component or components (hereinafter "rich solution") is heated in a vapor generator in counter-current heat exchange with the heating fluid to produce a vapor-liquid mixture which is introduced into a lower zone of a rectifier and separated therein into a solution having a lower concentration of said lower boiling component or components (hereinafter "lean solution") and a vapor mixture; the enthalpy of the vapor mixture in counter-current heat exchange with said heating fluid at its highest temperature; the vapor mixture is then expanded to a low pressure level thereby to perform the function of the cycle; and the spent vapor mixture is introduced into an absorber wherein it is dissolved in said lean solution, under heat rejection to an external coolant, so as to regenerate a rich solution;

said method being characterized in that:

(a) the pressure of the rich solution regenerated in the absorber is increased and the solution is divided into a first and second parts;

(b) said first part of the rich solution is heated in a regenerative heat exchanger by counter-current heat exchange with said lean solution which is drawn from the lower zone of the rectifier, whereafter said first part of the rich solution is recycled to the vapor generator, whereas said lean solution is decompressed by means of an expansion device and fed to the absorber;

(c) said second part of said rich solution is passed through a preheater to extract, by counter-current heat exchange, additional heat from the heating fluid leaving the vapor generator, whereby said second part of said rich solution is heated to the liquid saturation state and is then fed into the upper zone of the rectifier for counter-current mass and heat exchange with said vapor-liquid mixture, thereby to increase the concentration of the lower boiling component in said vapor mixture;

(d) the mass flow-rate of said first part of the rich solution is determined so as to render its apparent heat capacity mass flow rate substantially equal to that of said lean solution passing counter-current thereto through the regenerative preheater;

(e) the composition of the vapor mixture leaving the rectifier is adjusted, by controlling the pressure of the rich solution leaving the absorber and the mass flow rate of the higher boiling component, or components, circulating between the absorber and the rectifier, within technological limits, so that, for a selected vapor mixture flow rate, the temperature of the vapor mixture leaving the superheater is maximized.

2. A method according to claim 1, characterized in that the absorber is of the heat recuperative type wherein the regenerated rich solution is recirculated through the absorber through continuous flow channels in an indirect heat exchange relationship with the fluid mixture in the absorber so as to extract a substantial proportion of the heat of absorption generated therein.

3. A method according to claim 2 wherein the absorber is a multi-stage recuperative absorber.

4. A method according to claim 1 wherein at least one internal stream of working fluid is passed through the vapor generator for counter-current heat transfer to a portion of the rich solution therein, thereby recovering some of the heat energy of said internal stream (or streams).

5. A method according to claim 1 wherein the working fluid system comprises ammonia as a lower boiling component and water as the carrier fluid.

6. A method according to claim 5 wherein the working fluid system consists of a mixture of ammonia and water.

7. A method according to claim 4, wherein the vapor mixture from the superheater is expanded in a first turbine to produce mechanical work, the partially spent vapor mixture from said first turbine is recirculated through the superheater to increase its enthalpy and is then expanded in a second turbine to produce additional mechanical work, the spent vapor mixture from said second turbine is passed through the vapor generator therein to transfer some of its thermal energy to the rich solution, whereafter the vapor mixture is expanded in a third turbine to generate more mechanical work and the spent vapor mixture from said third turbine is recycled to the absorber.

8. A method according to claim 7 wherein the working fluid system comprises ammonia as a lower boiling component and water as the carrier fluid.

* * * * *